US007982597B2

(12) United States Patent
Koida

(10) Patent No.: US 7,982,597 B2
(45) Date of Patent: Jul. 19, 2011

(54) DEVICE FOR DETECTING CURRENT-IMPRESSED SIGNALS IN SECURITY SYSTEMS

(75) Inventor: Gerhard Koida, Munich (DE)

(73) Assignee: Robert Bosch GmbH, Stuttgart (DE)

( * ) Notice: Subject to any disclaimer, the term of this patent is extended or adjusted under 35 U.S.C. 154(b) by 857 days.

(21) Appl. No.: 10/589,017

(22) PCT Filed: Jan. 4, 2005

(86) PCT No.: PCT/EP2005/050018

§ 371 (c)(1),
(2), (4) Date: Jan. 14, 2008

(87) PCT Pub. No.: WO2005/076239

PCT Pub. Date: Aug. 18, 2005

(65) Prior Publication Data

US 2008/0150741 A1 Jun. 26, 2008

(30) Foreign Application Priority Data

Feb. 9, 2004 (DE) ..... 10 2004 006 195

(51) Int. Cl.
*G08B 1/08* (2006.01)

(52) U.S. Cl. ..... 340/533; 340/3.51; 340/505; 340/514; 340/506; 340/511

(58) Field of Classification Search ..... 340/3.51, 340/505, 514, 506, 507, 511
See application file for complete search history.

(56) References Cited

U.S. PATENT DOCUMENTS 6,583,628 B2 * 6/2003 Ropke ..... 324/523

FOREIGN PATENT DOCUMENTS

DE 27 55 826 6/1979
DE 100 48 599 4/2002

* cited by examiner

*Primary Examiner* — Daryl Pope
(74) *Attorney, Agent, or Firm* — Kenyon & Kenyon LLP

(57) ABSTRACT

A device and method for detecting current-impressed useful signals, added to a DC supply current, for a digital alarm line security system are described. To operate the alarm system using high DC supply currents on the alarm line without significantly affecting the reception of the useful signals, a current bypass branch containing a second current sensor element, a control amplifier, and an actuator for adjusting the resistance of the current bypass branch is provided in parallel to a first current sensor element designed for picking up the signals, the actuator being controlled by the control amplifier in such a way that a constant current adjusted to a setpoint value input at the control amplifier flows through the current bypass branch, the setpoint value being defined by a microprocessor as a function of time in such a way that the current flowing through the first current sensor element contains the useful signals having an essentially unreduced amplitude, and a reduced portion of the DC component of the supply current.

10 Claims, 2 Drawing Sheets

Stand der Technik

DEVICE FOR DETECTING CURRENT-IMPRESSED SIGNALS IN SECURITY SYSTEMS

FIELD OF THE INVENTION

The present invention is directed to a device and a method for detecting current-impressed useful signals added to a DC supply current for a digital alarm line security system, in particular for security systems having a high supply current demand for a plurality of alarm, control, and signaling devices connected thereto.

BACKGROUND INFORMATION

Alarm systems such as fire alarm systems and/or break-in alarm systems usually have an alarm center including an attached local signal line network via which peripheral sensors are connected in certain areas of a building to be monitored, for example. These sensors are motion alarms or fire alarms, for example. Such security systems are predominantly designed according to digital alarm line technology.

For easy installation and low overall costs, the peripheral sensors and other network elements such as couplers are supplied with power from the alarm center via a two-wire line. The information is transmitted over this alarm line from the alarm center to the sensors via voltage-modulated signals, which are superimposed on the supply voltage. Information from the sensors to the alarm center is transmitted via current-modulated signals which are added to the supply current needed by the sensors. These current-impressed signals are detected by a current sensor element in the alarm center. In order to achieve simple signal analysis using this information, all alarms and couplers are designed as constant current sinks which always draw the same current within their allowed operating range, regardless of the voltage applied. During operation, the system is always operated using a signal-superimposed and therefore variable DC voltage applied to the peripheral elements, while a signal-superimposed and therefore variable DC current is flowing.

A configuration of a security system using digital alarm line technology disclosed in German Patent No.-100 48 599 is schematically shown as a highly simplified block diagram in FIG. 1.

Series-connected peripheral sensors 4, 6, 8, 12, and 14 are connected to alarm center 1 in a ring structure as a local security network (LSN).

An alarm center 1 has an alarm line terminal 2 and a power supply terminal 3 for the ring input, and an alarm line terminal 10 and a power supply terminal 11 for the ring output. Alarm line terminal 2 is connected to alarm line 16. In this example, alarm line 16 is the local security network (LSN) by Bosch.

Alarm line terminal 10 is also connected to alarm line 16. Power supply terminals 3 and 11 are connected to power supply line 17. Alarms 4, 6, 8, 12, and 14 are connected in series to alarm line 16. Power supply devices 5, 7, 13, and 15 are connected in series to power supply line 17, while alarm 8 may be supplied with power via alarm line 16. Simultaneous signal transmission and power supply over alarm line 16 are achieved by modulating both the supply voltage and the current. Alarm center 1 transmits data via pulse-length-coded modulation of the supply voltage to alarm 8. The alarm center also transmits data via pulse-length-coded information to alarms 4, 6, 12, and 14. In the case of multiple sensors 4, 6, 8, 12, and 14, alarm center 1 assigns successive digital addresses at which alarms 4, 6, 8, 12, and 14 are subsequently addressed via the appropriate pulse-length-coded voltage modulation. For a supply voltage of 30 V, the voltage range of these signals is approximately 1.6 V.

Alarm 8 supplied with power via alarm line 16 transmits its response signals, i.e., useful signals, to alarm center 1 via pulse-length-coded modulation of the current received. Alarms 4, 6, 12, 14 transmit their response signals, i.e., useful signals, to the alarm center also via pulse-length-coded modulation of the current received. These useful signals for alarm center 1 are coded as current peaks of approximately 10 mA, are picked up via a 5-ohm resistor used as a current sensor in alarm center 1 and, after conversion to digital voltage signals, supplied to a processor for analysis.

The required current intensity is determined as a function of the number and type of sensors 8, 4, 6, 12, and 14 connected to alarm line 16. In this exemplary embodiment corresponding to the related art, the maximum current intensity on alarm line 16 is 100 mA. This limits the number and power consumption of the alarms supplied with power exclusively via alarm line 16 as a function of the power consumption. In the related art usually only alarms having low power consumption, such as fire alarms, are supplied with power in this way. In contrast, alarms 4, 6, 12, and 14, which require more power, receive the power required by the sensor system via power supply line 17. These alarms receive the low power for the electronics which makes communication with the alarm center possible also via the alarm line.

In addition to systems having a ring structure, there are also alarm systems having alarms connected via spur lines.

In the known alarm systems, the current sensor element is usually designed as an ohmic resistor. The signal current intensities analyzable as signals equal approximately 10 mA. As long as a supply current or basic current of a maximum of 100 mA or 300 mA, respectively, is needed on the alarm line for supplying the peripheral network elements, the useful signal to noise ratio, e.g., the noise level, is kept within acceptable limits for reception.

However, if considerably higher supply currents or basic currents are required due to a correspondingly larger number of connected alarm, control, and signaling devices according to the present trend toward increased security via higher monitoring complexity, the useful signal to noise ratio becomes less favorable. For example, at a supply current intensity of 1.5 A, the noise in the receive amplifier circuit would reach a level at which the approximately 10 mA useful signal would be difficult or impossible to detect at an ohmic resistor. Such a signal current amplitude, however, is still highly desirable for these types of security systems for reasons of compatibility with existing central signal processing and signal analysis systems.

An excessively high power loss of $P=R*I^2=5\text{ ohms}*(1.5\text{ A})^2=11.25$ watts would also occur across a 5-ohm resistor typically used for detection. Therefore, in presently known alarm systems, alarms and other network elements which would cause the current intensity to exceed 100 mA or 300 mA on the alarm line are supplied with power by an additional power supply line. This is associated with additional cost and complexity.

This signal reception problem may possibly be overcome by filtering out the entire DC current component using a frequency filter to subsequently analyze the AC current component. However, in doing so, the signal shape is disadvantageously affected in the case of large detection ranges, for example, between 1000 m to 3000 m, as required in larger alarm systems. In addition, the filter components are relatively expensive when designed for relatively high current intensities.

SUMMARY OF THE INVENTION

A useful signal in the range of 10 mA may be detected with sufficiently high quality and low power loss even in alarm systems having a high maximum DC supply power far exceeding 300 mA.

This is achieved essentially by providing, in addition to a first current sensor element for picking up the signals, a current bypass branch, which represents a controlled constant current sink, the control operating in such a way that the current flowing through the first current sensor element contains the useful signals having an essential unreduced amplitude and a reduced portion of the DC component of the supply current. Due to the fact that most of the DC supply current flows through the current bypass branch according to the present invention adapted in time to the instantaneous supply current intensity, only a reduced DC component of the supply current is conducted, without substantially affecting the amplitude of the useful signal, through the first current sensor element designed for picking up the signals. This advantageously results in a low power loss across the first current sensor element and an improved useful signal to noise ratio.

The operation of large alarm systems, in which the power is supplied to a plurality of connected sensors and network elements, some of which have a relatively high power consumption, over the alarm line, is ensured by the present invention without substantially affecting signal reception.

According to an advantageous embodiment of the present invention, the setpoint value for the constant current in the current bypass branch, which is determined by the microprocessor, is supplied to the control amplifier via a digital-analog converter. In this way the signal of the microprocessor is adapted to the conditions for the control amplifier in a simple manner.

According to another advantageous embodiment of the present invention, the microprocessor picks up the instantaneous supply current value from a current sensor element installed in the supply current line to determine the setpoint value. This is a simple way of determining the time-dependent supply current. According to another, alternative option for determining the time-dependent supply current, the microprocessor is able to compute the current by knowing the connected sensors and alarms, as well as the state of the supplied power-consuming control and signaling elements (such as LED on/off).

Furthermore, the design of at least one of the current sensor elements as an ohmic resistor is advantageous, since this is an uncomplicated and cost-effective variant.

Particularly advantageous is the adjustment of the level of the setpoint value to fluctuations of the reference potential of the control amplifier using an ohmic resistor installed between the reference potential point and the control amplifier. By thus refining the present invention, the correct setpoint value is always available to the control amplifier for controlling the actuator which sets the constant current in the bypass branch, even in the case of a reference voltage varying over time.

A useful signal having an amplitude between 10 mA and 15 mA is advantageous for compatibility reasons. A reduced portion of a maximum of 100 mA of the supply current flowing through the first current sensor has been found particularly advantageous for such useful signal amplitudes due to the low power loss and good signal to noise ratio. One embodiment of the device according to the present invention which regulates the constant current through the current bypass branch accordingly for this purpose represents a further advantageous feature of the present invention.

According to another advantageous embodiment, the actuator which sets the resistance, i.e., the current flow, in the current bypass branch is designed in a simple and cost-effective manner as a transistor. Due to its cost-effective manufacture, very low resistance when fully conductive, and compact dimensions, a MOS field-effect transistor is particularly well-suited for this purpose.

DETAILED DESCRIPTION

In the figures, the same reference symbols identify the same components or components having an identical function.

Figure 2:
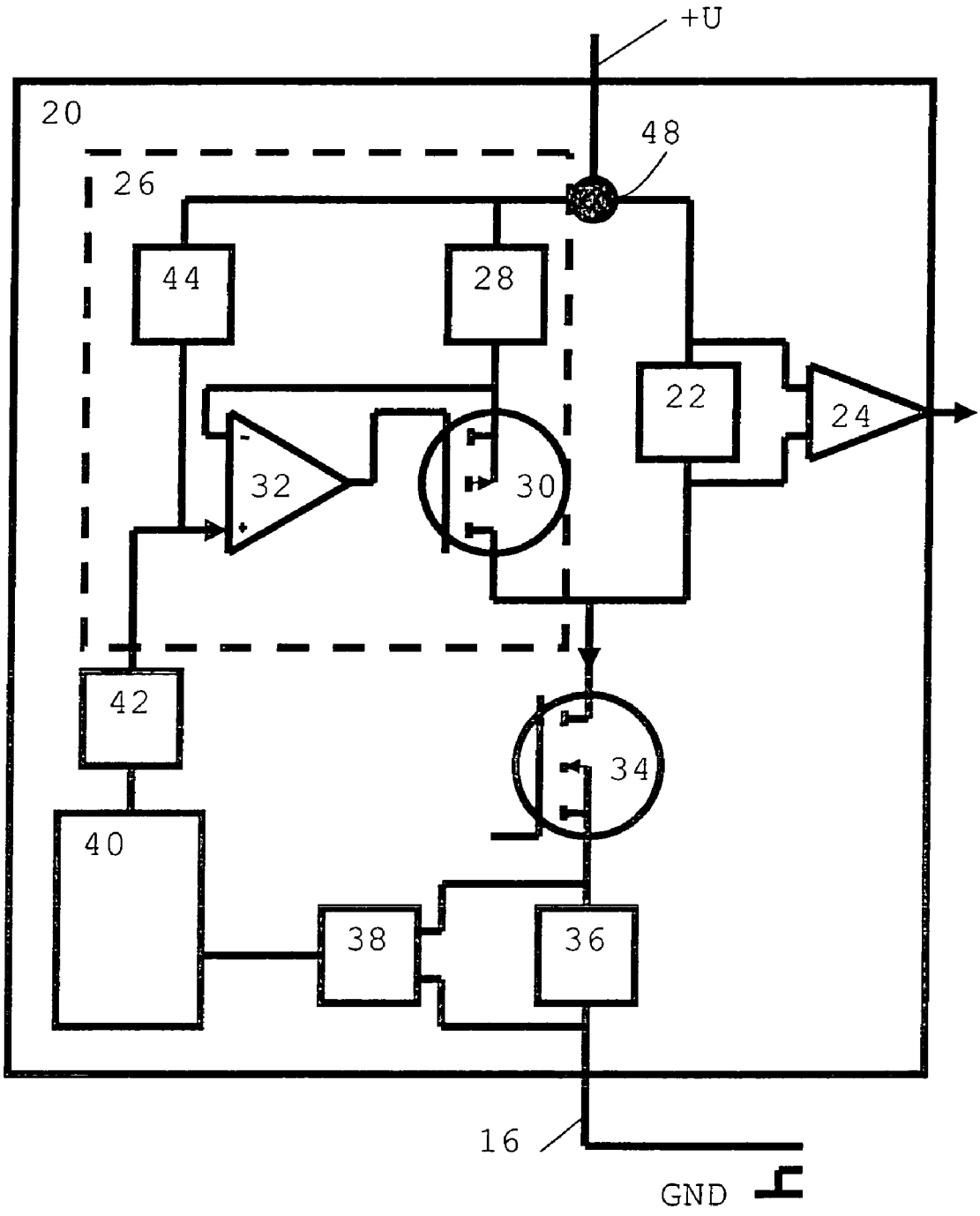
FIG. 2 shows a schematic wiring diagram of an exemplary embodiment of the device according to the present invention in a digital alarm line security system.

FIG. 2 shows a schematic wiring diagram of an exemplary embodiment of device 20 of the present invention in a digital alarm line security system.

Figure 1:
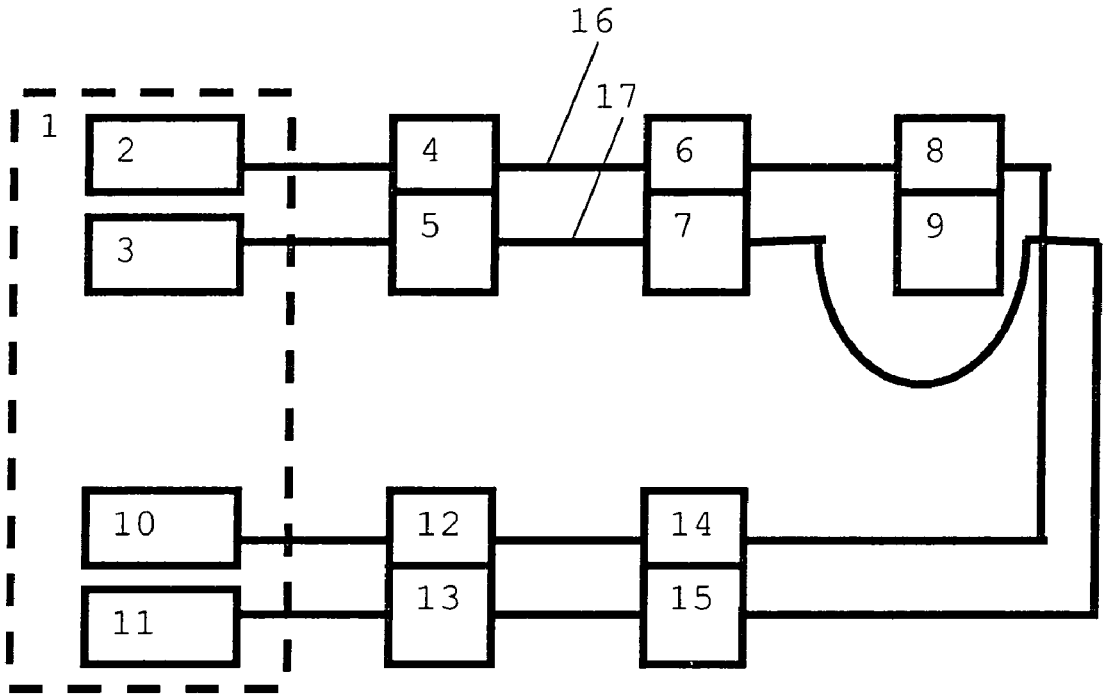
FIG. 1 shows a simplified block diagram of an exemplary embodiment of a digital alarm line security system known from the related art.

Device 20 according to the present invention is part of an alarm center 1 of an alarm system shown in FIG. 1. Therefore, it is the starting point or end point of a signal line ring or a spur line. The signals of sensors or alarms are output to alarm line 16.

The current-impressed useful signals having an amplitude of approximately 10 mA and emitted by the connected alarms as pulse length-coded modulations of the current intensity are converted into signals of a voltage drop across a first current sensor 22 and amplified by a receiving amplifier 24 for analysis. First current sensor 22 is, for example, an ohmic resistor having a resistance in the range of 5 ohms.

According to the present invention, only a reduced portion of maximum 100 mA of the DC supply current as well as the essentially unreduced current-impressed useful signal, which is also applied to the line are conducted through current sensor 22. The other portion of the supply current flows, according to the present invention, through current bypass branch 26 of the present invention, which is identified in FIG. 2 by a dashed line and is connected in parallel to current sensor 22. The current flow in current bypass branch 26 passes by current sensor 28, which is a low-resistance resistor in the range of 0.1 ohms, for example, through an actuator 30 to a transmitter output stage transistor 34, at which the two parallel current branches are reunited.

Actuator 30, which is used for setting the resistance, i.e., the current flow, in bypass branch 26, is a MOS field-effect transistor (MOSFET), for example, another type of transistor, or another type of resistor having sufficiently high-speed regulation which does not affect any essential spectral components of the useful signal. Transistor 30 is controlled by a control amplifier 32, which is connected to the gate of transistor 30. The actual value for the current flowing through bypass branch 26 is supplied to the negative input of the control amplifier as the voltage drop across current sensing resistor 28.

According to the exemplary embodiment, control amplifier 32 controls the current through transistor 30 according to a setpoint value provided to it by a microprocessor 40. This setpoint value is determined according to the instantaneous DC supply current flowing at alarm line terminal 16 in that, as shown by FIG. 2 for example, the voltage drop across it is queried by microprocessor 40 using a low-resistance resistor 36 of 0.5 ohms, for example, which functions downstream from output stage transistor 34 as a current sensor in the transmission output stage, the voltage values being converted by an interposed analog-digital converter 38 into signals which are readable by microprocessor 40. This voltage drop is then proportional to the supply current, which measures up to several amperes in large systems. According to a preferred embodiment, microprocessor 40 uses this signal for the instantaneous magnitude of the supply current to determine a setpoint value of the constant current flowing through bypass branch 26.

This constant current corresponds to a predefined, relatively large portion of the DC component of the supply current, so that the DC current intensity of the remaining portion of the supply current does not substantially exceed the approximate value of 100 mA, known from the related art and readily processable for small systems. The supply current demand may vary, for example, during address assignment to the alarms and other LSN elements or during actions controlled by the alarm center such as switching LEDs in LSN elements on or off. According to the present invention, microprocessor 40 adjusts the setpoint value of the constant current determined by it to these variations in the supply current over time.

Microprocessor 40 transmits the setpoint value of the constant current, converted by an interposed digital-analog converter 42, as an appropriate voltage value U(Isetpoint) to the positive input of control amplifier 32. As described above, the voltage drop across current sensing resistor 28 is applied to its negative input as the actual value.

Depending on whether the actual value is higher or lower than the setpoint value of the constant current through bypass branch 26, control amplifier 32 regulates transistor 30 according to the present invention to a smaller or greater current passage to attain the constant current setpoint value. As a result, only a residual DC component of a maximum of 100 mA of the supply current and the essentially unreduced current-impressed useful signals flow according to the present invention and as needed through current sensing resistor 22 connected in parallel to bypass branch 26.

To adjust the level of the setpoint value to fluctuations of the reference voltage of control amplifier 32, an ohmic resistor 44 is advantageously situated in a secondary branch from reference potential point 48 to the setpoint value input of control amplifier 32. In this case, the setpoint value is no longer output by DA converter 42 as a voltage value, but as a current value. The current passes through resistor 44 and produces a voltage drop across it, which is applied as a voltage value U(Isetpoint) to the setpoint input of the control amplifier. The reference voltage (reference potential point 48) may be advantageously shifted thereby within certain limits without affecting the setpoint value definition.

Although the present invention is described above with reference to a preferred exemplary embodiment, it is not limited thereto, but may be modified in many ways.

Thus, it is also possible to include two devices according to the present invention for receiving useful signals in an alarm center of an alarm system in the case of a ring structure of the connected peripheral sensors—one at the beginning and one at the end of the ring.

Instead of microprocessor 40, which defines the setpoint value for the bypass branch via DA converter 42 and optionally inputs the total current via DA converter 38 and current sensor 36, it is also possible to use an analog (amplifier) circuit, which outputs the setpoint value for the bypass branch at its output. The output value as an output current or output voltage is proportional to the input signal (current or voltage) which is picked up by current sensor 36.

What is claimed is:

1. A device for detecting a current-impressed signal, added to a DC supply current for a digital alarm line security system, comprising:

a first current sensor element for detecting the current-impressed signal; and a current bypass branch provided in parallel to the first current sensor element, the current bypass branch representing a controlled constant current sink, wherein a control is performed in such a way that a current flowing through the first current sensor element contains the current— impressed signal having an essentially unreduced amplitude, and a reduced portion of a DC component of a supply current.

2. The device as recited in claim 1, wherein:

the current bypass branch includes:

a second current sensor element, a control amplifier, and an actuator for adjusting a resistance of the current bypass branch, the actuator being controlled by the control amplifier in such a way that a constant current adjusted to a setpoint value which is input at the control amplifier flows through the current bypass branch, the setpoint value being defined by a microprocessor as a function of time.

3. The device as recited in claim 1, further comprising:

a digital-analog converter via which the setpoint value determined by the microprocessor is supplied to the control amplifier.

4. The device as recited in claim 2, further comprising:

a third current sensing element installed in a supply current line, wherein the microprocessor picks up a supply current value for determining the setpoint value from the third current sensor element.

5. The device as recited in claim 4, wherein at least one of the first current sensor element, the second current sensor element, and the third current sensor element includes an ohmic resistor.

6. The device as recited in claim 4, further comprising:

an ohmic resistor installed between a reference potential point and the control amplifier, wherein the level of the setpoint value is adjusted to fluctuations of a reference potential of the control amplifier via the ohmic resistor.

7. The device as recited in claim 1, wherein the current-impressed signal has an amplitude between 10 mA and 15 mA.

8. The device as recited in claim 1, wherein a constant current through the current bypass branch is regulated in such a way that the reduced portion of the supply current flowing through the first current sensor element connected in parallel thereto is a maximum of 100 mA.

9. The device as recited in claim 2, wherein the actuator is a MOS field-effect transistor.

10. A digital alarm line security system, comprising:

a device for detecting a current-impressed signal, added to a DC supply current for a digital alarm line security system, the device including:

a first current sensor element for detecting the current-impressed signal; and a current bypass branch provided in parallel to the first current sensor element, the current bypass branch representing a controlled constant current sink, wherein a control is performed in such a way that a current flowing through the first current sensor element contains the current-impressed signal having an essentially unreduced amplitude, and a reduced portion of a DC component of a supply current.

* * * * *